US010238563B2

(12) United States Patent
Brulotte et al.

(10) Patent No.: US 10,238,563 B2
(45) Date of Patent: Mar. 26, 2019

(54) TILTABLE PATIENT CEILING LIFT ASSEMBLY

(71) Applicant: ArjoHuntleigh Magog Inc., Magog (CA)

(72) Inventors: Denis-Alexandre Brulotte, Orford (CA); Martin Faucher, Magog (CA); Olivier Custeau-Boisclair, Sherbrooke (CA)

(73) Assignee: ArjoHuntleigh Magog Inc., Quebec (CA)

( * ) Notice: Subject to any disclaimer, the term of this patent is extended or adjusted under 35 U.S.C. 154(b) by 0 days.

(21) Appl. No.: 15/527,573

(22) PCT Filed: Nov. 17, 2015

(86) PCT No.: PCT/CA2015/051198

§ 371 (c)(1),
(2) Date: May 17, 2017

(87) PCT Pub. No.: WO2016/077921

PCT Pub. Date: May 26, 2016

(65) Prior Publication Data

US 2017/0354560 A1 Dec. 14, 2017

Related U.S. Application Data

(60) Provisional application No. 62/080,909, filed on Nov. 17, 2014.

(51) Int. Cl.
*A61G 7/10* (2006.01)
*A61G 7/00* (2006.01)

(52) U.S. Cl.
CPC ..... *A61G 7/1042* (2013.01); *A61G 7/1015* (2013.01); *A61G 7/1034* (2013.01); *A61G 7/1051* (2013.01); *A61G 7/1076* (2013.01)

(58) Field of Classification Search
CPC .. A61G 7/1015; A61G 7/1019; A61G 7/1042; A61G 7/1051
USPC ..... 5/85.1, 83.1, 81.1 R
See application file for complete search history.

(56) References Cited

U.S. PATENT DOCUMENTS

| | | | | |
|---|---|---|---|---|
| 3,123,224 A * | 3/1964 | Kral | A61G 7/1019 212/330 |
| 3,506,985 A | 4/1970 | Lang | |
| 3,877,089 A * | 4/1975 | Spivey | A61G 7/1011 5/85.1 |
| 4,446,587 A | 5/1984 | Jump | |
| 4,627,119 A * | 12/1986 | Hachey | A61G 7/1015 5/85.1 |
| 5,694,654 A | 12/1997 | Roy | |

(Continued)

FOREIGN PATENT DOCUMENTS

| | | |
|---|---|---|
| CA | 2647459 A1 | 10/2007 |
| DE | 4009283 A1 | 9/1991 |

*Primary Examiner* — Robert G Santos
(74) *Attorney, Agent, or Firm* — The Webb Law Firm

(57) ABSTRACT

A patient ceiling lift system including motor units that are attached to independent pivotable support members of a support frame assembly. The motor units are able to pivot on the support frame and relative to one another, which enables the motor units to follow the loading direction on tension support members connectable to a patient sling and eliminate motor unit side loading.

16 Claims, 7 Drawing Sheets

(56) References Cited

U.S. PATENT DOCUMENTS

| | | | | |
|---|---|---|---|---|
| 6,006,377 | A * | 12/1999 | Asakawa | A61G 7/1015 5/612 |
| 6,711,759 | B1 * | 3/2004 | Kluckhuhn | A61G 7/1019 5/81.1 R |
| 7,062,804 | B2 * | 6/2006 | Rouse | A61G 7/1015 5/83.1 |
| 8,549,679 | B2 * | 10/2013 | Tindall | A61G 7/1015 5/81.1 R |
| 9,757,297 | B2 * | 9/2017 | Arespong | A61G 7/1051 |
| 2005/0044629 | A1 * | 3/2005 | Rouse | A61G 7/1015 5/81.1 R |
| 2007/0240260 | A1 | 10/2007 | White et al. | |
| 2009/0308828 | A1 | 12/2009 | Hansen | |
| 2011/0239367 | A1 * | 10/2011 | Gramkow | A61G 7/1015 5/83.1 |
| 2012/0198612 | A1 * | 8/2012 | Tindall | A61G 7/1015 5/83.1 |
| 2014/0223660 | A1 * | 8/2014 | Bolin | A61G 7/10 5/83.1 |
| 2015/0216753 | A1 * | 8/2015 | Arespong | A61G 7/1013 5/83.1 |
| 2017/0354559 | A1 * | 12/2017 | Brulotte | A61G 7/1015 |
| 2017/0354560 | A1 * | 12/2017 | Brulotte | A61G 7/1042 |
| 2017/0360635 | A1 * | 12/2017 | Brulotte | A61G 7/1015 |
| 2017/0360637 | A1 * | 12/2017 | Brulotte | A61G 7/1073 |

* cited by examiner

TILTABLE PATIENT CEILING LIFT ASSEMBLY

CROSS-REFERENCE TO RELATED APPLICATIONS

This application is the United States national phase of International Application No. PCT/CA2015/051198 filed Nov. 17, 2015, and claims priority to U.S. Provisional Patent Application No. 62/080,909 filed Nov. 17, 2014, the disclosures of which are hereby incorporated in their entirety by reference.

TECHNICAL FIELD

The present disclosure relates to a patient ceiling lift assembly for use, for example, in a hospital or care home.

BACKGROUND OF THE DISCLOSURE

Ceiling lifts for lifting and transporting patients have been in use for over twenty years. These types of patient lift are becoming more popular as they take up little space in a hospital or care home environment and are more efficient than floor lifts.

A ceiling lift can be described as a motor unit able to move along one or more rails arranged as a rail system, fixed to the ceiling. A flexible member such as a strap extends from the motor unit and is attached to a spreader bar. A patient sling or harness is attached to the spreader bar. An electrically motorized mechanism in the motor unit allows the user to extend or shorten the strap so as to raise or lower the spreader bar and with this to raise or lower the sling and any patient carried in the sling. The combination of rail system, motor unit, spreader bar and sling is often referred to as a ceiling lift system.

Some ceiling lift systems are said to be fixed (the motor unit is dedicated to one room) while others are said to be portable (the motor unit can move around from room to room).

Over the last decades the size (weight & morphology) of patients has increased, causing manufacturers of ceiling lift systems to develop solutions which better address the handling challenges larger patients pose. The initial response from manufacturers was to increase the lifting capacity of their existing products. Since then, patient handling techniques were developed, industry standards were established and user (patient and care givers) needs were better understood. It appears that there was room for devices which could do more than just having a greater lifting capacity and be able to transfer a patient in a fixed seated position. Indeed, users were in the need of a product with greater versatility.

One design adopted by manufacturers for handling patients of very large size (with a Body Mass Index above 40 or of weight above 160 kg, for example) has two motor units with two spreader bars which operate together. In one configuration, one of the motor units and its associated spreader bar supports/lifts the shoulder section of the patient, while the other motor unit and spreader bar supports/lifts the patient's leg section. A key benefit of such solution is the ability to provide a tilting function to sit or recline the patient during transfer, by creating a height difference between the spreader bars. Bringing the leg section spreader bar above the shoulder section spreader bar leads to a patient reclined position, while bringing the leg section spreader bar below the shoulder section spreader bar leads to a patient sitting position.

A tilting function can increase patient comfort and reduce caregiver effort to transfer a patient. Although the above-described solutions for very large patients can provide significant benefits, they can sometimes have the drawback of being suitable only to such patient morphology. Care institutions face the challenge of making the care environment, typically the patient rooms, as versatile as possible when it comes to the range of patients they can handle. As a result the patient environment should be able to accommodate very large patients but also very small patients. Otherwise, a room dedicated for very large sized patients can often be unoccupied for long periods of time.

Ceiling lift systems based on the use of two motor units and two spreader bars can be arranged to have the motor units able to move apart from one another, for example slidably located on a support rail, or can be fixed in position. While an arrangement which allows for the motor units to move apart can better accommodate a large patient, they can suffer from a loss of compactness of the apparatus and from loss of strength of the assembly. Fixed motor units can, however, only accommodate larger patients awkwardly.

SUMMARY OF THE DISCLOSURE

The present disclosure relates to an improved patient ceiling lift system.

According to an aspect of the present disclosure, there is provided a patient ceiling lift system, including: first and second motor units; first and second tension support members each coupled to a respective one of the first and second motor units, each motor unit being operable to change an operative length of its associated strap element by extending or retracting the strap out of or into the motor unit, each strap element including a coupling for attachment to a patient sling; a support frame assembly to which the first and second motor units are attached, the support frame assembly including a coupling for a ceiling carrier system; wherein the support frame assembly includes first and second independent pivotable support members to which the first and second motor units are attached, whereby the motor units are able to pivot on the support frame and relative to one another.

According to another embodiment, there is provided a patient ceiling lift system that includes first and second motor units; first and second tension support members each coupled to a respective one of the first and second motor units. Each motor unit is operable to change the operative length of its associated tension support member element by extending or retracting the tension support member out of or into the motor unit. The motor units are attached to first and second independent pivotable support members of a support frame assembly which also includes a coupling for a ceiling carrier system. The motor units are able to pivot on the support frame and relative to one another, which enables the motor units to follow the loading direction on the tension support member and eliminate motor unit side loading. The pivoting of the motor units also effectively increases the horizontal distance between the points of origin of the flexible load supporting tension support member, which reduces the shear stress on a patient when in the reclined position. The structure can also provide a compact device while maximizing patient room in the reclined position.

The provision of a pivoting motion to the motor units enables them to turn in the direction of a pulling force on the straps, enabling them between to accommodate the spacing between the straps or other tension support members of a sling. This improves the operation of the motor units.

Moreover, the arrangement can avoid the need to have motor units which are able to move apart, and can therefore contribute to a more compact system at reduced cost. Other embodiments combine the concept of tiltable motor units with a system which enables the distance between the motor units to be changed, for example by having the motor units mounted on a rail.

In an embodiment, the pivotable support members are able to rotate by between 15 and 25 degrees. It has been found that such a range of pivoting meets the requirements of ceiling lift systems, although the range could be extended to greater pivoting angles should the need arise, for instance where the ceiling height is particularly low.

Advantageously, in an embodiment the pivotable support members are rectangular or square section tubular closed end elements having one or more connection points for connection to the motor units. Elements of such a shape enable good fixation of the motor units to the support members and also provide significant strength to the support members. In an illustrative embodiment, the pivotable support members advantageously rotate about an axle at their closed ends.

In an example embodiment, the support frame assembly includes first and second plate members disposed one over the other, the first plate member including the coupling for a ceiling carrier system and the pivotable support members being attached to the second plate member. In an embodiment, the first and second plate members are connected to one another by a rotatable coupling enabling the first and second frame members to rotate relative to one another. The rotatable coupling can include first and second concentric ring elements rotatably coupled to one another, the first ring element being fixed to the first plate member and the second ring element being fixed to the second plate member. Such a coupling can be made to have a significant diameter, which enables the coupling to support very heavy weights and also asymmetric weights, for instance when just one of the motor units is used to support a patient.

In an embodiment, the first and second concentric ring elements have a diameter at least 50% of a width of the first and second plate members. They may, in practice, have a much greater diameter, typically just smaller than the width of the plate members.

In an example embodiment, the first and second plate members each include a plurality of upstanding flange walls extending from a base plate element of the member. These walls contribute to the strength of the plate members and reduce their deformation when subjected to very heavy loads. The coupling for a ceiling carrier system is, in an embodiment, located on the upstanding flange walls of the first plate member.

In an embodiment, the coupling advantageously includes a series of wheel elements. In an example embodiment, the rail coupling includes at least three pairs of wheel elements.

In an example embodiment the first motor unit is a leading motor unit and the second motor unit is a driven motor unit. Each wheel element may include first and second coaxially mounted wheels, which may be disposed on opposite sides of an upstanding flange wall of the support frame assembly.

Other features and aspects of the disclosure herein will become apparent from the disclosure of the illustrative embodiments, which follows.

BRIEF DESCRIPTION OF THE DRAWINGS

Embodiments of the present disclosure are described below, by way of example only, with reference to the accompanying drawings, in which.

DESCRIPTION OF THE ILLUSTRATIVE EMBODIMENTS

Figure 1:
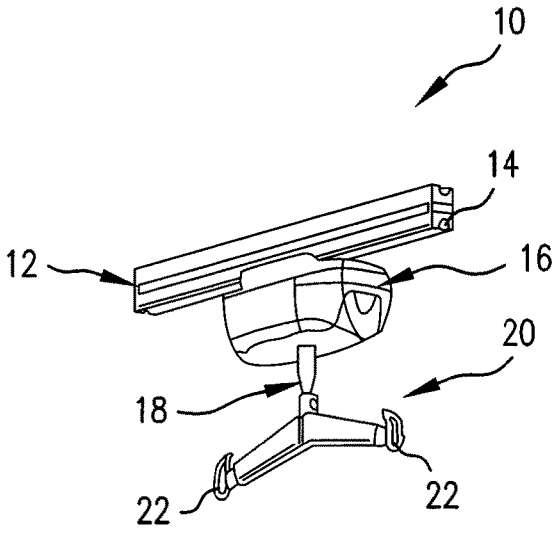
FIGS. 1 and 2 show an example of a prior art ceiling lift system, spreader bar and sling.

Referring first to FIG. 1, this shows a conventional ceiling lift system 10 which includes a rail 12 that is fixed to the ceiling structure of a patient care facility, such as a hospital, care home or the like. The rail 12 includes a downwardly depending channel 14. The system 10 may include a transmission, winding or coiling assembly, having for example a motor unit 16 which includes a wheel or roller (not shown) which runs within the downwardly depending channel 14 to allow the motor unit 16 to be moved in supported manner along the rail 12, as is known in the art.

Figure 2:
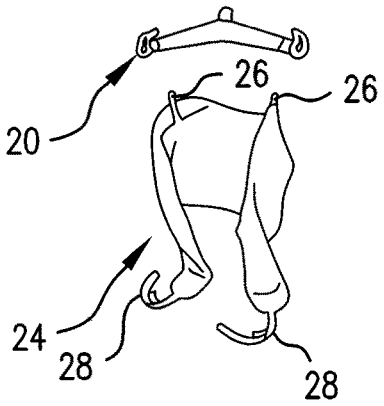

The motor unit 16 is operatively associated with, coupled to and/or includes a tensile support member, such as a flexible element or strap 18, which in practice is attached to a motorised spool or drum within the motor unit 16, and which can be unwound from the spool to lengthen the strap 18 and wound on the spool to shorten the strap 18, again in known manner. One skilled in the art would appreciate that one or more or any number of tensile support members may be operatively associated with, coupled to and/or form part of a motor unit to facilitate patient support. In one embodiment, the tensile support member is configured to be coilable about the drum or motorized spool of motor unit 16 and having sufficient tensile strength for lifting a patient. In an exemplary embodiment, the support member may be rigid in tension along its length yet permit motion in other directions to dynamically support a patient, inclusive of bariatric patients. Exemplary support members may include webbing, belts, rope, wire, cord, cable and chains. The strap 18 includes a coupler at its lower, free end, to which there can be attached a spreader bar 20, again of known form. The coupling can be any fastener, connector, attachment or securement mechanism suitable for connection to spreader bar 20. The spreader bar 20 includes coupling points 22, which are spaced from one another and specifically at either end of the bar 20. The coupling points 22 act as attachments for a sling 24, as shown in FIG. 2. The sling 24 is provided with a plurality of straps 26, 28, which attach to the coupling points 22 so that the sling 24 is held by the spreader bar 20 in an open condition to support a patient comfortably in the sling 24. These slings are well known in the art.

Figure 3:
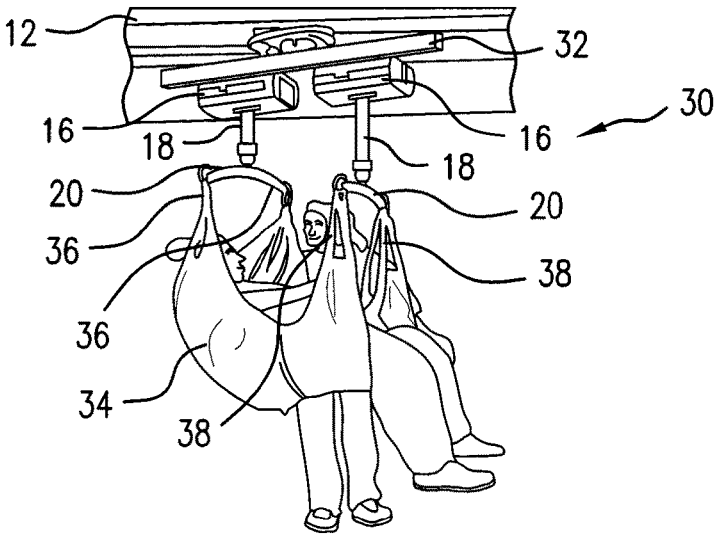
FIG. 3 shows an example of a double motor ceiling lift system.

While a system as shown in FIGS. 1 and 2 is suitable for lifting and transporting patients up to moderate sizes, heavier or larger patients cannot be carried by a simple system of this nature. In this regard, the apparatus of FIG. 3 is generally used. The apparatus 30 includes two motor units 16 which are attached to a support unit 32, is coupled to the rail 12, as in the example of FIG. 1. The apparatus 30 includes two spreader bars 20, each attached to a respective strap 18 of a respective motor unit 16. The motor units 16 are spaced from one another so that one strap 18 and its associated spreader bar 20 can be located around the top of the patient's torso, whereas the other motor unit and spreader bar 20 is located around the patient's thigh position. A sling 34 includes pairs of straps 36, 38 coupling to respective spreader bars 20, which allow a patient to be held within the sling 34 in a gently reclining position as shown in the example of FIG. 3.

The motor units 16 are operable to release and withdraw lengths of strap 18 such that the spreader bars 20 can be raised or lowered as required. For instance, the straps 18 can be lengthened to lower the spreader bars 20 towards a patient reclining on a bed and then wound into the motor units 16 to raise the spreader bars 20 and thus to raise the patient while carried in the sling 34. The motor units 18 are, for this purpose, controlled by a caregiver such as nurse, and are advantageously movable independently of one another when the patient is moved to different positions while suspended in the sling 34. For example, the patient can be held in a substantially reclining position as shown in FIG. 3 or could be raised to a sitting position, by raising the spreader bar 20 at the torso end of the patient.

The patient ceiling lift apparatus 30 shown in FIG. 3 spaces the motor units 16 from one another in order to have the motor units positioned generally vertically above the spreader bars when the sling is in the patient reclining position. While this is suitable in the configuration shown, spacing the motor units 16 in this manner leads to a larger assembly and also one which is not optimal for asymmetric use, that is using a single motor unit 16 only.

Figure 4:
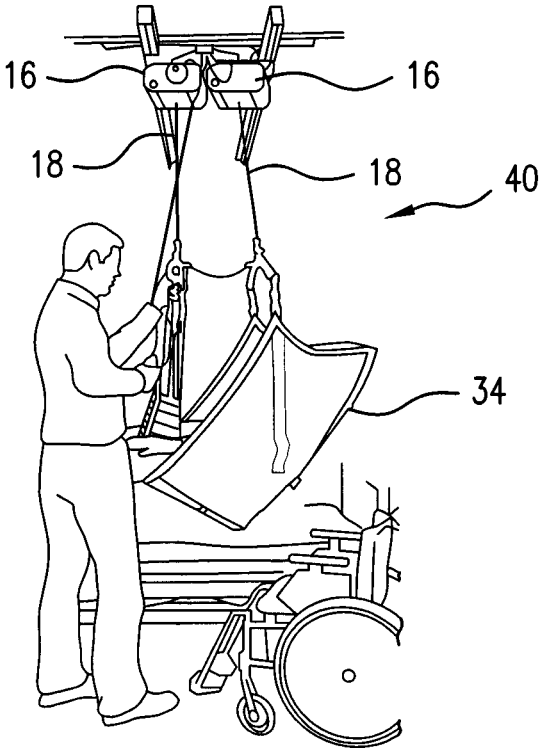
FIG. 4 is a schematic diagram showing a double motor unit ceiling hoist system attached to a patient sling.
Figure 5:
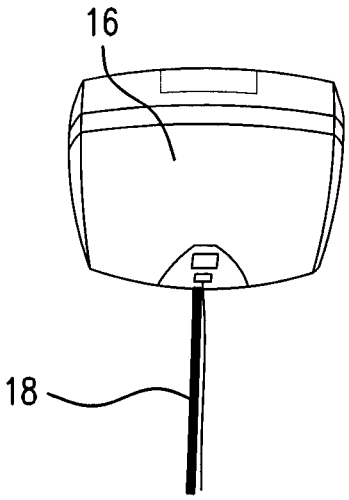
FIGS. 5 and 6 shows the effect on the strap of one of the motor units caused by different sling configurations.
Figure 6:
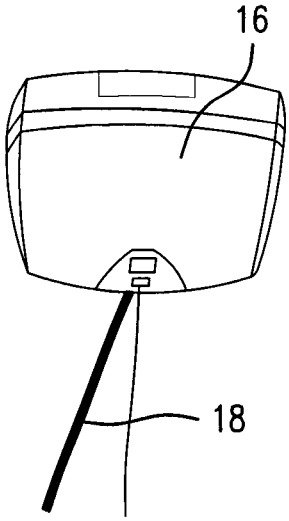
Figure 7:
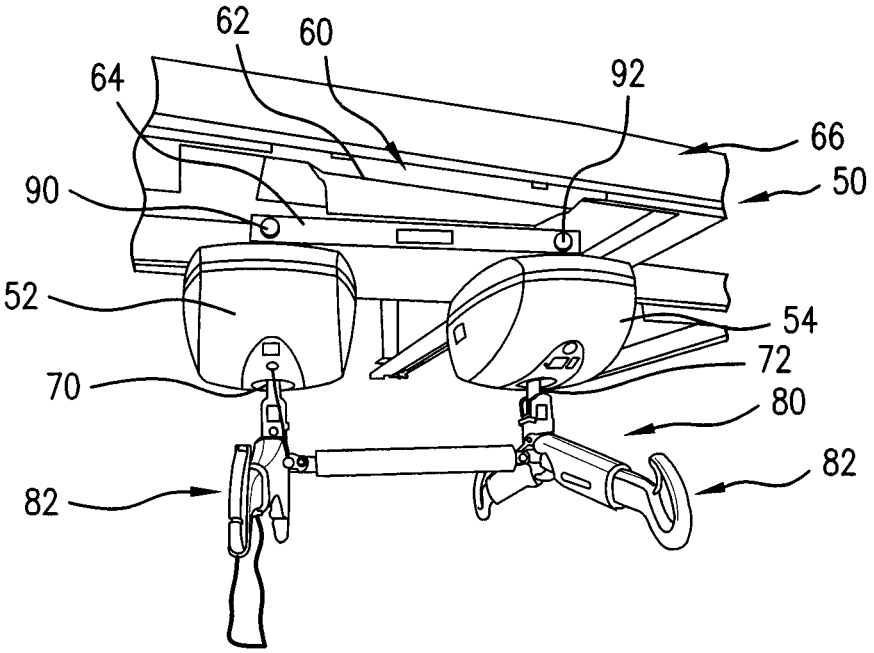
FIGS. 7 to 11 depict an example embodiment of a ceiling lift system according to the teachings herein.
Figure 8:
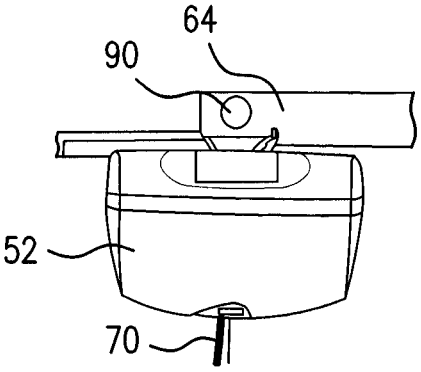

FIG. 4 shows an assembly 40 in which the two motor units 16 are positioned adjacent one another and which can be seen provides a more compact assembly that the example shown in FIG. 3. The assembly can also be stronger and better able to support asymmetric loads, for instance when using a single motor unit to carry a patient. As a result of the positioning of the motor units 16 adjacent one another, the strap elements 18 are also close to one another. While this does not generally cause a problem with a smaller patient or with a patient in an upright sitting position, it does cause problems with larger patients. With reference to FIG. 5, the strap 18 can be seen extending from the motor unit 16 in a generally vertical orientation, as it is designed to do. On the other hand, with reference to FIG. 6, the strap 16 can be seen extending at an angle to the vertical, as would occur when the assembly is supporting a sling/patient having greater distances between the two spreader bars, as can occur with a large patient and a patient in the reclining position. This imparts side stress on the motor unit 16, which it is not designed to withstand and which contributes to increased friction and wear. When the motor units 16 and straps 18 are exposed to such stresses on a frequent or too numerous basis they can fail prematurely. Furthermore, the forces imparted to the sling will pull the sling to a closed position, causing shear stress on the patient, leading to patient discomfort.

An example embodiment of ceiling lift assembly 50 is shown in FIGS. 7 to 12. With reference to these Figures, the assembly 50 includes first and second motor units 52, 54, which may be structurally the same as the motor units of the examples of FIGS. 1 and 3 to 6, or any other known or suitable motor unit. Each motor unit 52, 54 includes a motor and a drum (neither visible in the Figures but as is typical located within the casing of the motor unit), and a strap element 70, 72, respectively, which is wound on the drum. Operation of the motor will wind or unwind the strap element 70 or 72 onto or from the drum, thereby to alter the length of the strap element 70, 72 extending out of the motor unit 52, 54. The strap elements 70, 72 have, as is conventional, attachment devices at their free ends for coupling to a spreader bar assembly 80. The assembly 80, in this example, includes two spreader bar yokes 82 connected together by a connection element 84.

Figure 9:
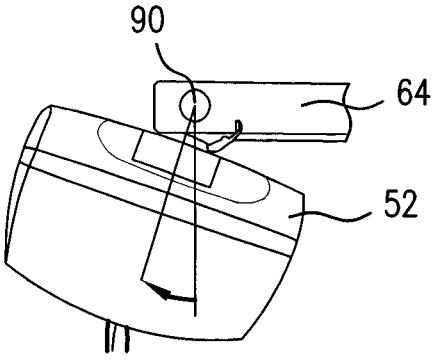
Figure 10:
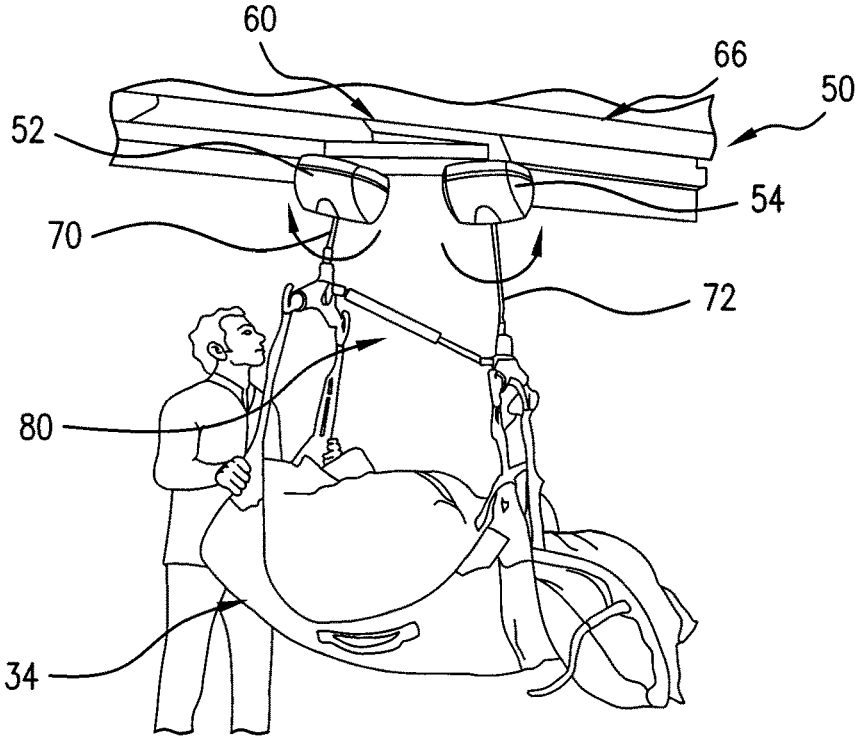
Figure 11:
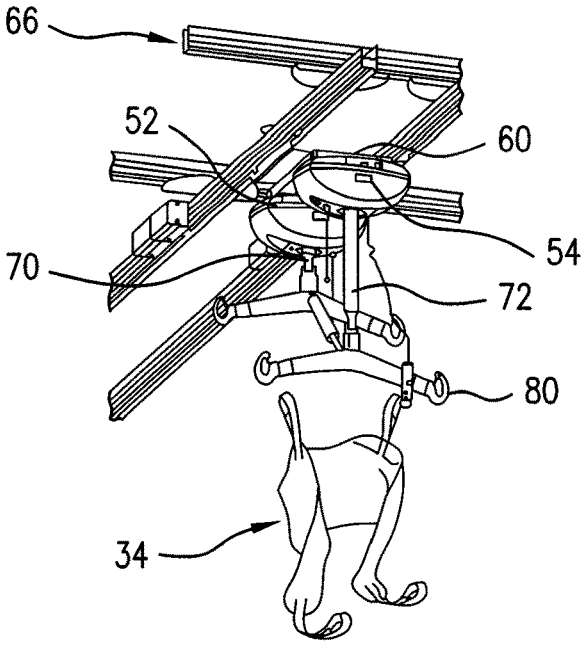

The assembly 50 also includes a support trolley 60 which couples to a ceiling rail system 66 and which is described in further detail below. The motor units 52 and 54 are attached to the support trolley 60, specifically to pivotable connection members 90, 92, described in detail below. The pivotable connection members 90, 92 allow the motor assemblies to pivot or rotate about the trolley 60, preferably about axes which are perpendicular to the longitudinal direction of the system, defined by the axis along which the two spreader bars 82 lie and in practice a head to toe direction of a patient. Thus, the motor units 52, 54 are able to pivot towards a patient's head and feet and in the direction in which the straps 70, 72 will in practice be pulled. FIGS. 9 and 10 depict particularly clearly how the motor units can tilt, leading them to remain generally aligned with the direction in which their respective strap elements 70, 72 are loaded. In the embodiment shown, the motor units 52, 54 are able to tilt by 15 to 25 degrees from the horizontal, which has been found to be adequate. The skilled person will appreciate, though, that the angle to which the motor units 52 and 54 can be allowed to tilt can be different and could be greater or smaller than this, depending of the ultimate design of the apparatus and its specific usage. The trolley 60 may be provided in some embodiments with limit stops to limit the maximum degree of tilt.

FIG. 10 shows particularly clearly how the tilt of the motor units 52, 54 enables them to follow better the direction in which their respective straps 70, 72 are pulled and as a result enables the straps 70, 72 to remain better aligned with respect to their motor units. The motor units 52, 54 will generally tilt in the direction of the arrows in FIG. 10, in practice in a direction away from one another.

Referring now to FIGS. 12 to 15, illustrated are details of the trolley unit 60 of the assembly 50. The trolley 60 is formed of upper and lower support plate members 62, 64. The upper plate member 62 includes a base panel 100 of generally rectangular or square shape and having at opposing sides two upstanding panel walls 102, 104. The walls 102, 104, which are parallel to one another, carry three sets of wheel units 106, 108, 110, each having two wheels on a common axle and disposed on either side of their associated panel wall 102, 104. The sets of wheel units 106, 108 are disposed close to one another at one end of their respective panel wall 102, 104, while the third set of wheel units 110 is disposed at the other end of the panel walls 102, 104. Thus, the wheel sets 106-110 are asymmetric along the lengths of the panel walls 102,104.

The lower support plate member 64 also comprises a base panel 120 which has a generally rectangular or square shape and which has at opposing sides upstanding side walls 122, 124, which extend beyond the ends of the base panel 120. The plate member 64 also includes upstanding end walls 126, 128 which are advantageously fixed to the side walls 122, 124, for example by welding, bonding or in any other manner. The upstanding walls 122-128 form a recess or chamber in the lower support member 64 for receiving a rotatable coupling member 150 described in further detail below.

Figure 12:
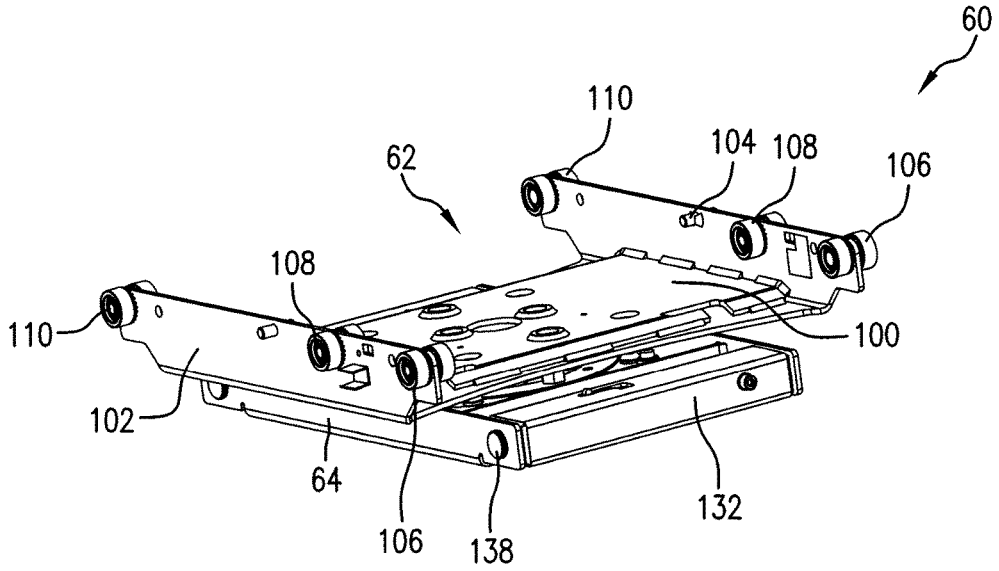
FIG. 12 is a perspective view of an embodiment of support trolley of the ceiling lift system of FIGS. 7 to 11.
Figure 13:
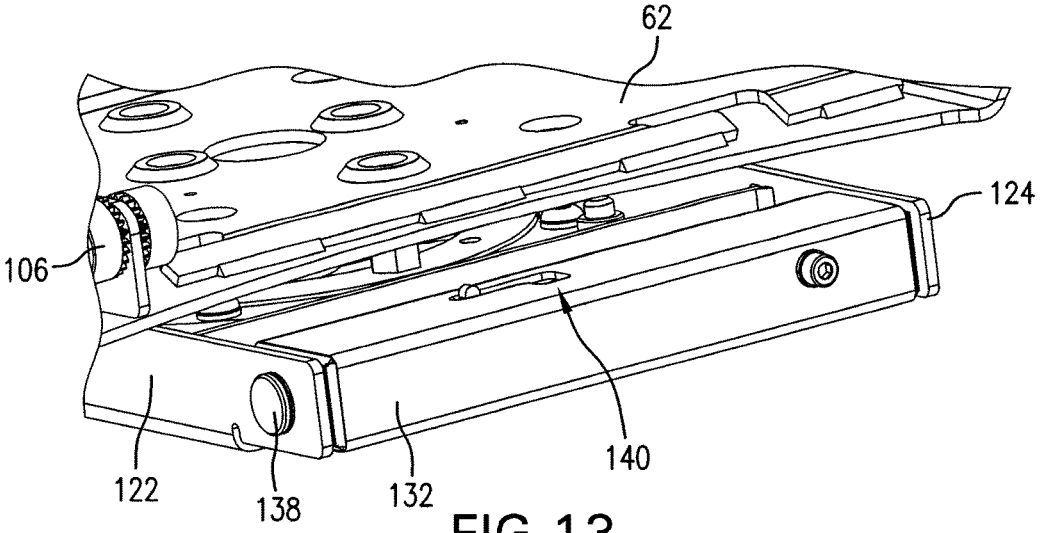
FIG. 13 is an enlarged view of a part of the support trolley of FIG. 12.
Figure 14:
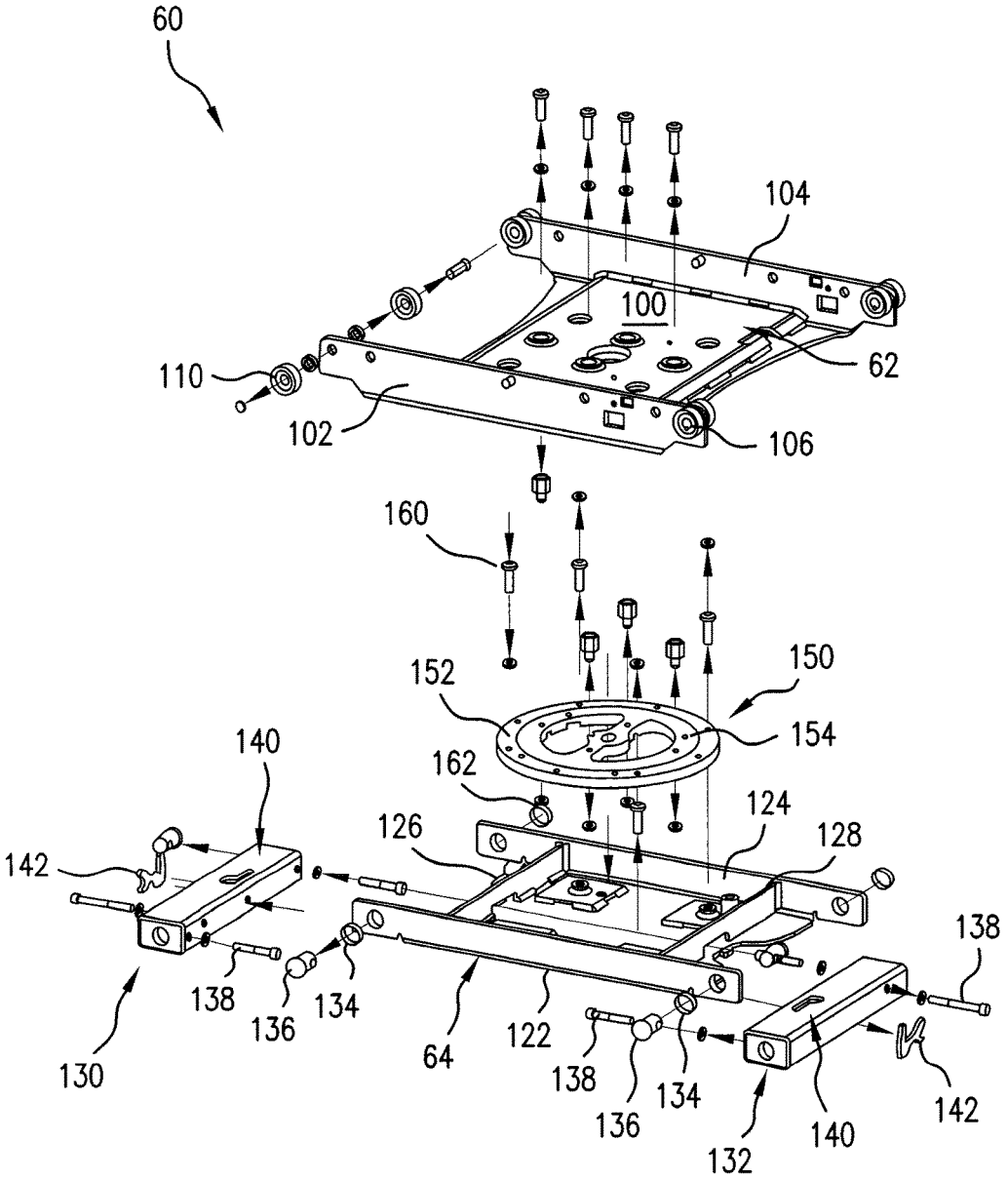
FIG. 14 is an exploded view of the support trolley of FIG. 12.
Figure 15:
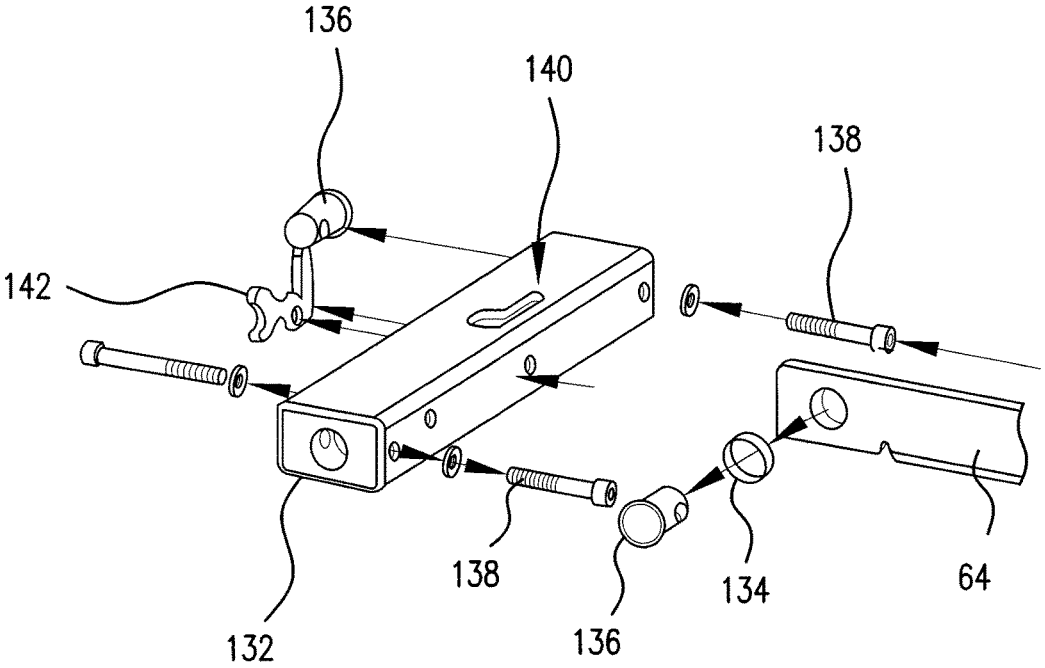
FIG. 15 is an enlarged view of a part of the components of the support trolley of FIG. 14.

The lower support member 64 also includes first and second pivotable support elements 130, 132 which in this embodiment are elongate rectangular box sections and which are sized to fit snugly between the upstanding side walls 122, 124, as can be seen in particular in FIGS. 12 and 13. The pivotable support members 130,132 are attached to the side walls 122,124 by an arrangement of dry polymer bushings 134 into which pivot pins 136 can pass, the latter being fixed to the support members 130,132 by bolts 138. These pins 136 fix the pivotable support members 130, 132 to the support member 64 in a manner in which they can rotate around an axis running though the opposing pivot pins 136, with the pivot pins 136 being solidary with the support members 130,132. The pivotable support members 130, 132 also include a fixing device, in this example a slot 140 and securing key 142. The motor units 52, 54 are fixed to the support member 130,132 from below, by suitable fixing members, suitable structures being immediately apparent to the skilled person.

The rotatable coupling member 150 includes first and second concentric ring elements 152, 154 which are designed to be rotatable relative to one another, for instance by having an array of ball bearings therebetween, running in facing channels in the ring elements 152, 154. Any other rotary mechanism could be used. Each ring element 152, 154 is provided with a plurality of holes, preferably threaded bores, into which bolts 160, 162 can be fitted, such that one of the ring elements 106, 162 is fixed to one of the base panels 100, 120 and the other ring element is fixed to the other base panel. The upper and lower support members 62, 64 are therefore attached to one another in a manner in which they can rotate about a vertical axis, in a horizontal plane. The rotatable coupling member 150 preferably has a substantial diameter, at least 50% of the width of the trolley 60 and preferably large enough to fill the area within the upstanding walls 122-128. A large diameter gives the coupling member 60 greater strength and makes it able to withstand asymmetric forces better.

The pivotable support members 130,132 and the upper and lower frame elements 62, 64 can usefully be made from sheets of metal or metal alloy.

The structure taught herein allows the motor units 52, 54 to pivot freely around an axis passing through their suspension point, namely around the axis of the pivot pins 136. This enables the motor units 52, 54 to follow the loading direction and eliminate motor unit side loading. The pivoting of the motor units 52, 54 also effectively increases the horizontal distance of between the points of origin of the flexible load supporting straps 70, 72, that is at the point where they exit their associated motor unit 52, 54. This reduces the shear stress on a patient when in the reclined position. In other words, the effect of the pivoting motion of the motor units 52, 54 provides more room for the patient if needed.

The structure taught herein can provide a compact device while maximizing patient room in the reclined position and as a result can minimize shear stress on the patient from the sling. The structure can also avoid the issue of side loading (of the type shown in FIG. 6) when lifting very large patients in the reclined position, thereby reducing the risk of premature wear and failure.

All optional and preferred features and modifications of the described embodiments and dependent claims are usable in all aspects of the illustrative embodiments taught herein. Furthermore, the individual features of the illustrative embodiments, as well as all optional and preferred features and modifications of the described embodiments are combinable and interchangeable with one another.

While systems and methods have been described with reference to certain embodiments within this disclosure, one of ordinary skill in the art will recognize that additions, deletions, substitutions and improvements can be made while remaining within the scope and spirit of the invention as defined by the appended claims.

The disclosure in the abstract accompanying this application is incorporated herein by reference.

We claim:

1. A patient ceiling lift system, comprising:

first and second motor units;

first and second tension support members each coupled to a respective one of the first and second motor units, each motor unit being operable to change an operative length of its associated tension support member by extending or retracting a strap out of or into the motor unit, each tension support member including a coupling for attachment to a patient sling;

a support frame assembly to which the first and second motor units are attached, the support frame assembly comprising:

a coupling for a ceiling carrier system;

first and second independently pivotable support members to which the first and second motor units are attached, whereby the first and second motor units are configured to pivot on the support frame assembly and relative to one another; and a rotatable coupling permitting rotation of the first and second pivotable support members relative to the ceiling carrier system about a vertical axis, wherein the first and second tension support members are spaced apart from the rotatable coupling where the first and second tension support members are coupled to the respective first and second motor units.

2. The ceiling lift system according to claim 1, wherein the pivotable support members are configured to rotate between 15 and 25 degrees.

3. The ceiling lift system according to claim 1, wherein the pivotable support members are rectangular section tubular closed end elements having one or more connection points for connection to the first and second motor units.

4. The ceiling lift system according to claim 3, wherein the first pivotable support member rotates about an axle positioned at a closed end of the first pivotable support member, and wherein the second pivotable support member rotates about an axle positioned at a closed end of the second pivotable support member.

5. The ceiling lift system according to claim 1, wherein the support frame assembly includes first and second plate members disposed one over the other, the first plate member including the coupling for the ceiling carrier system and the pivotable support members being attached to the second plate member.

6. The ceiling lift system according to claim 5, wherein the first and second plate members are connected to one another by the rotatable coupling enabling the first and second plate members to rotate relative to one another.

7. The ceiling lift system according to claim 6, wherein the rotatable coupling includes first and second concentric ring elements rotatably coupled to one another, the first ring element being fixed to the first plate member and the second ring element being fixed to the second plate member.

8. The ceiling lift system according to claim 7, wherein the first and second concentric ring elements have a diameter at least 50% of a width of the first and second plate members.

9. The ceiling lift system according to claim 5, wherein the first and second plate members each include a plurality of upstanding flange walls extending from a base plate of the member.

10. The ceiling lift system according to claim 9, wherein the coupling for a ceiling carrier system is located on the upstanding flange walls of the first plate member.

11. The ceiling lift system according to claim 1, wherein the coupling for a ceiling carrier system comprises a plurality of wheel elements.

12. The ceiling lift system according to claim 1, wherein the coupling for a ceiling carrier system includes at least three pairs of wheel elements.

13. The ceiling lift system according to claim 11, wherein each wheel element comprises first and second coaxially mounted wheels.

14. The ceiling lift system according to claim 13, wherein the first and second coaxially mounted wheels are disposed on opposite sides of an upstanding flange wall of the support frame assembly.

15. A patient ceiling lift system, comprising:

first and second motor units;

first and second tension support members each coupled to a respective one of the first and second motor units, each motor unit being operable to change an operative length of its associated tension support member by extending or retracting a strap out of or into the motor unit, each tension support member including a coupling for attachment to a patient sling;

a support frame assembly to which the first and second motor units are attached, the support frame assembly including a coupling for a ceiling carrier system;

wherein the support frame assembly includes first and second independently pivotable support members to which the first and second motor units are attached, whereby the first and second motor units are configured to pivot on the support frame assembly and relative to one another, and wherein the pivotable support members are rectangular section tubular closed end elements having one or more connection points for connection to the first and second motor units.

16. A patient ceiling lift system, comprising:

first and second motor units;

first and second tension support members each coupled to a respective one of the first and second motor units, each motor unit being operable to change an operative length of its associated tension support member by extending or retracting a strap out of or into the motor unit, each tension support member including a coupling for attachment to a patient sling;

a support frame assembly to which the first and second motor units are attached, the support frame assembly including a coupling for a ceiling carrier system; and a spreader assembly comprising a connection element attaching a first yoke and a second yoke, the first yoke connected to the coupling of the first tension support member and the second yoke connected to the coupling of the second tension support member, wherein the connection element sets a distance between the first yoke and the second yoke, wherein the support frame assembly includes first and second independently pivotable support members to which the first and second motor units are attached, whereby the first and second motor units are configured to pivot on the support frame assembly and relative to one another, and wherein the first and second tension support members are spaced apart from the coupling for the ceiling carrier system where the first and second tension support members are coupled to the respective first and second motor units.

* * * * *